US011703300B1

(12) United States Patent
Chang

(10) Patent No.: US 11,703,300 B1
(45) Date of Patent: Jul. 18, 2023

(54) ADJUSTABLE STOCK OF A CROSSBOW

(71) Applicant: Combis Sport Enterprise Co., Ltd., Taichung (TW)

(72) Inventor: Chu-Wei Chang, Taichung (TW)

(73) Assignee: Combis Sport Enterprise Co., Ltd., Taichuna (TW)

( * ) Notice: Subject to any disclaimer, the term of this patent is extended or adjusted under 35 U.S.C. 154(b) by 0 days.

(21) Appl. No.: 17/747,213

(22) Filed: May 18, 2022

(51) Int. Cl.
*F41B 5/12* (2006.01)

(52) U.S. Cl.
CPC ..... *F41B 5/12* (2013.01)

(58) Field of Classification Search
CPC ..... F41B 5/12
See application file for complete search history.

(56) References Cited

U.S. PATENT DOCUMENTS 5,749,348 A * 5/1998 Oviedo-Reyes ..... F41B 5/12 124/25
5,931,145 A * 8/1999 Oviedo-Reyes ..... F41B 5/12 124/20.3
7,748,370 B1 * 7/2010 Choma ..... F41B 5/12 124/25
9,528,789 B2 * 12/2016 Biafore, Jr. ..... F41B 5/1403

FOREIGN PATENT DOCUMENTS

TW I691697 B 4/2020

* cited by examiner

*Primary Examiner* — John A Ricci
(74) *Attorney, Agent, or Firm* — Karin L. Williams; Alan D. Kamrath; Mayer & Williams PC

(57) ABSTRACT

A stock assembly of a crossbow includes a fore-end stock, a butt stock, and a lock. The fore-end stock includes a slot in a lateral face and a chamber in a rear face. The slot is in communication with the chamber. The butt stock includes an insert movably inserted in the chamber, a shoulder contact portion formed at an end of the insert out of the chamber, and recesses in a lateral face of the insert. The lock is pivotally connected to the fore-end stock and insertable in a selected one of the recesses through the slot.

10 Claims, 8 Drawing Sheets

ADJUSTABLE STOCK OF A CROSSBOW

BACKGROUND OF INVENTION

1. Field of Invention

The present invention relates to a crossbow and, more particularly, to an adjustable stock assembly of a crossbow.

2. Related Prior Art

A conventional crossbow includes a rail, a limb (or limbs), a stock, and a string. The rail is connected to a front section of the rail. The stock is connected to a rear section of the rail. Two ends of the string are tied to two ends of the limb. The limb extends in a transverse direction of the rail. The limb extends in a longitudinal direction of the rail. Hence, the crossbow is bulky, and it is troublesome to store or carry the crossbow.

A compact crossbow with a reduced size is disclosed in Taiwanese Patent No. 1691697 issued to the applicant of the present application. The compact crossbow is smaller than the conventional crossbow. However, the length of the stock of the compact crossbow is still a problem for some users.

Moreover, the conventional crossbow or the compact crossbow is made with a constant total length (the sum of the length of the rail and the length of the stock). The constant length is not suitable for all users.

The present invention is therefore intended to obviate or at least alleviate the problems encountered in the prior art.

SUMMARY OF INVENTION

It is the primary objective of the present invention to provide a crossbow with an adjustable stock assembly.

To achieve the foregoing objective, the stock assembly includes a fore-end stock, a butt stock, and a lock. The fore-end stock includes a slot in a lateral face and a chamber in a rear face. The slot is in communication with the chamber. The butt stock includes an insert movably inserted in the chamber, a shoulder contact portion formed at an end of the insert out of the chamber, and recesses in a lateral face of the insert. The lock is pivotally connected to the fore-end stock and insertable in a selected one of the recesses through the slot.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
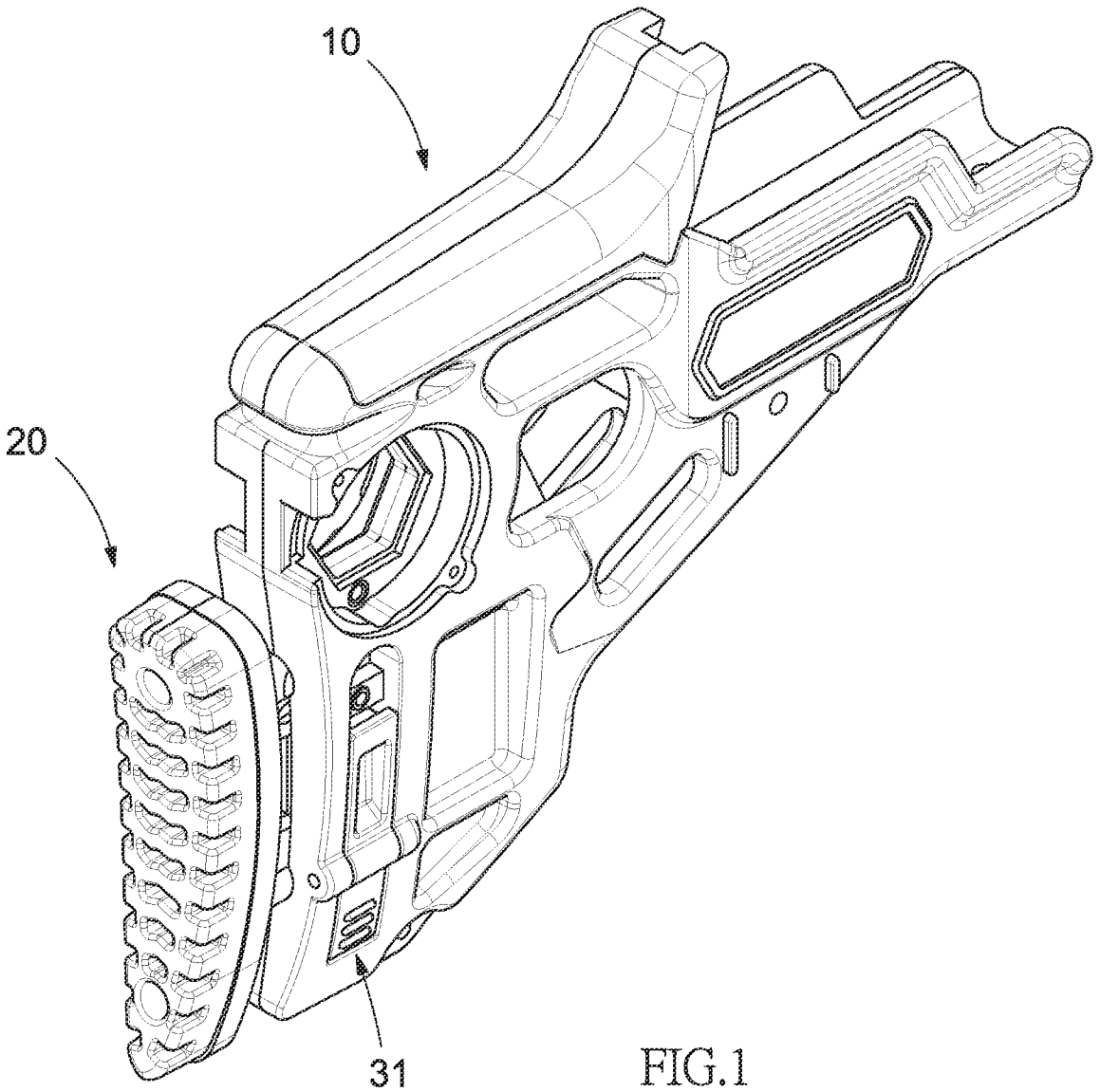
FIG. 1 is a perspective view of a stock assembly of a crossbow according to the preferred embodiment of the present invention.
Figure 2:
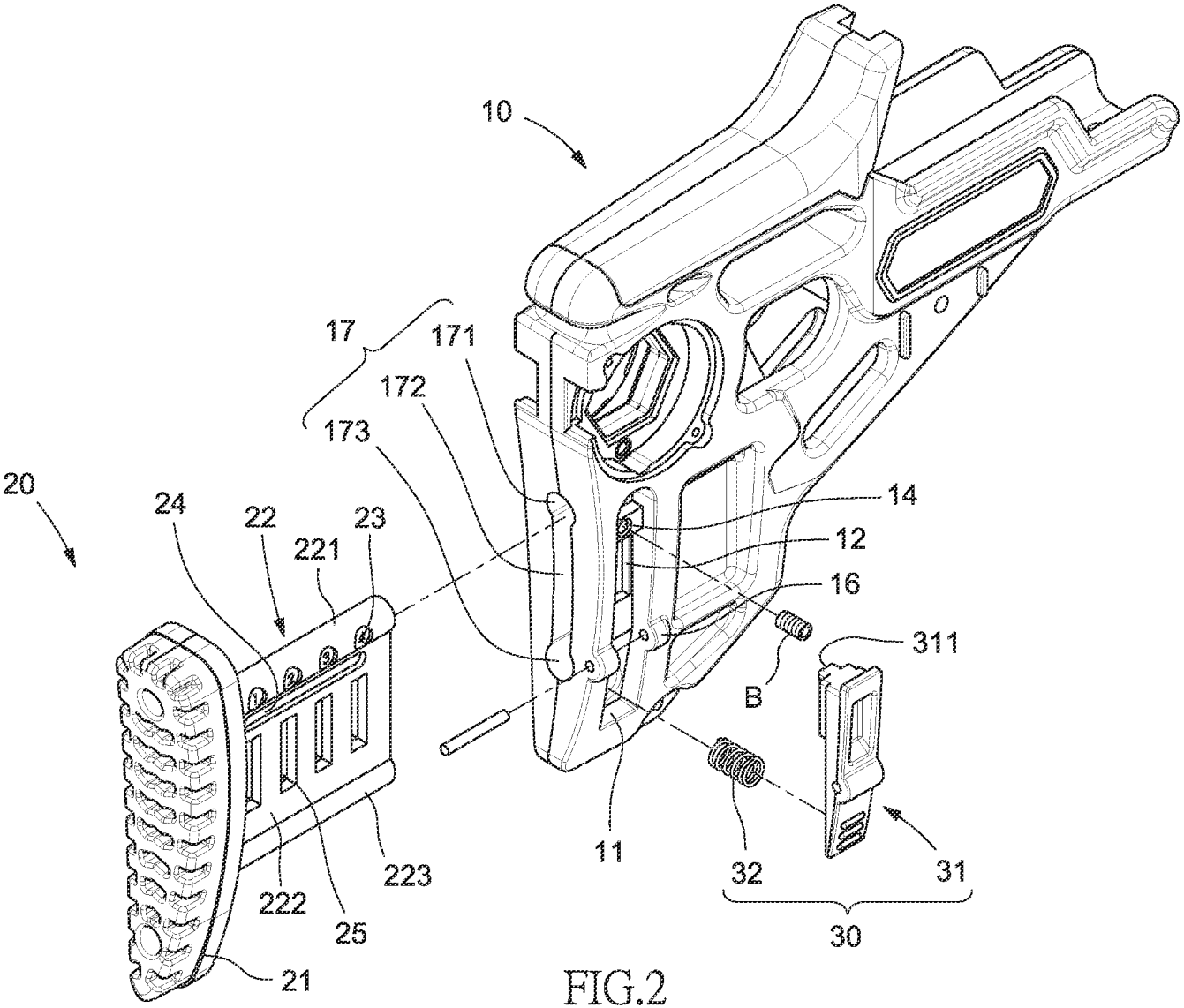
FIG. 2 is an exploded view of the stock assembly shown in FIG. 1.
Figure 3:
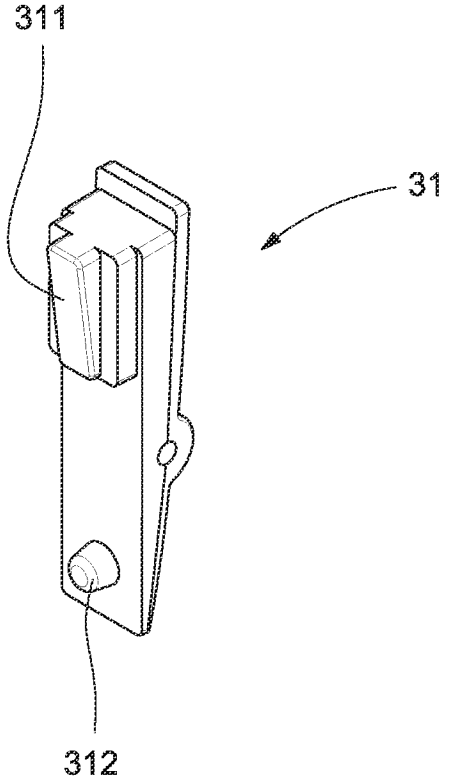
FIG. 3 is a perspective view of a lock of the stock assembly shown in FIG. 2.
Figure 4:
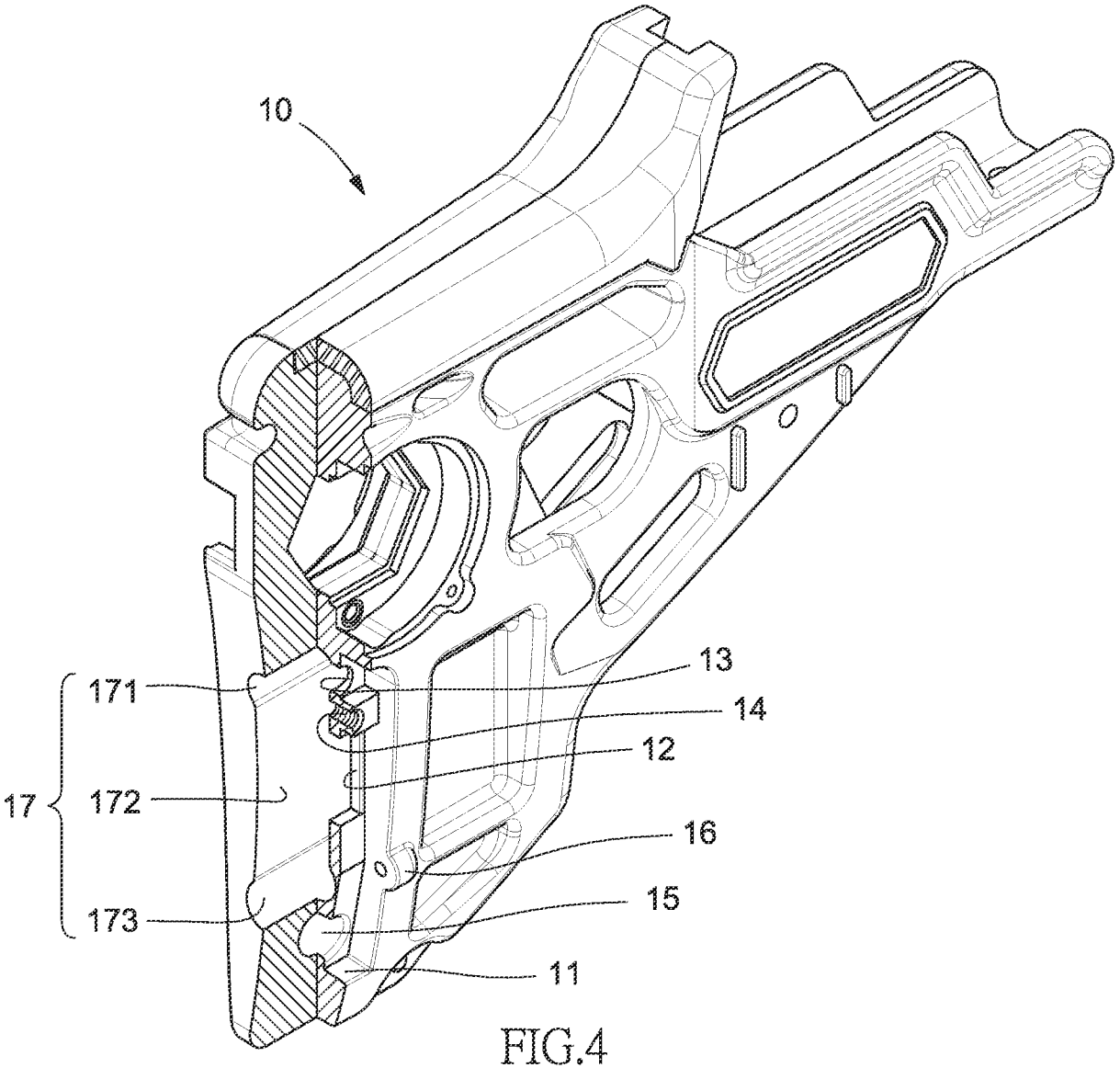
FIG. 4 is a cut-away view of the stock assembly shown in FIG. 1.
Figure 5:
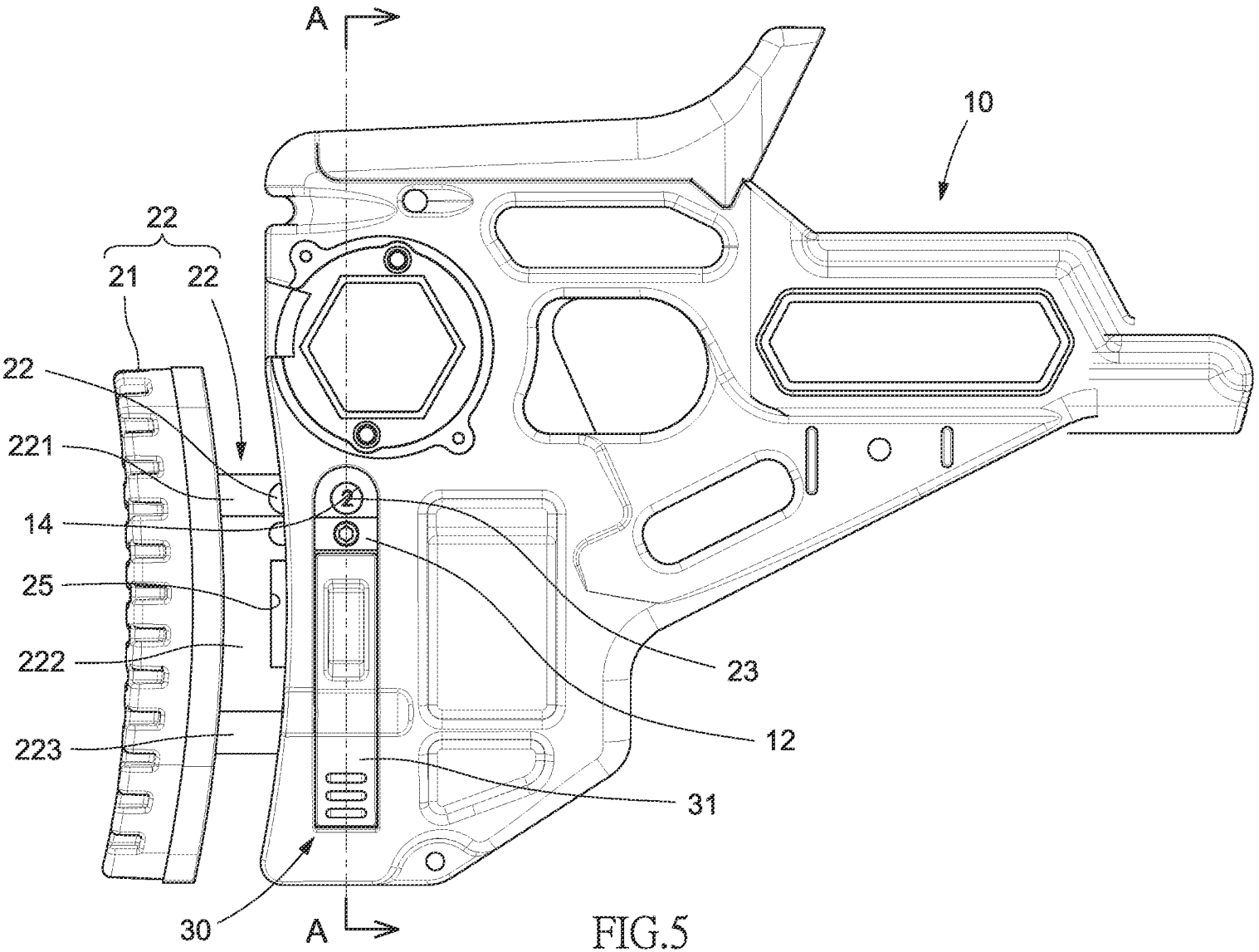
FIG. 5 is a side view of the stock assembly shown in FIG. 1.

Referring to FIGS. 1 to 6, an adjustable stock assembly of a crossbow includes a fore-end stock 10, a butt stock 20, and a lock 30 according to the preferred embodiment of the present invention.

The fore-end stock 10 is connected to a rail (not shown) of the crossbow. The fore-end stock 10 includes a trench 11, a slot 12, a window 13, a screw hole 14, bore 15, two lugs 16, and a chamber 17.

The trench 11 is made in a lateral face (such as the righthand side) of the fore-end stock 10.

The slot 12 is also made in the lateral face of the fore-end stock 10. The slot 12 is located in the trench 11.

The window 13 is also made in the lateral face of the fore-end stock 10. The window 13 is located in the trench 11, near the slot 12.

The screw hole 14 is also made in the lateral face of the fore-end stock 10. The screw hole 14 is located in the trench 11, adjacent to the slot 12. The screw hole 14 is intended to receive a threaded bolt B for example.

The bore 15 is also made in the lateral face of the fore-end stock 10. The bore 15 is located in the trench 11. Preferably, the bore 15 is located near a closed end of the trench 11 while the slot 12 is located near another closed end of the trench 11.

The lugs 16 are formed on the lateral face of the fore-end stock 10. The trench 11 (or the slot 12) is located between the lugs 16.

The chamber 17 is made in a rear face of the fore-end stock 10 while the rail of the crossbow is connected to a front face of the fore-end stock 10. The chamber 17 is in communication with the window 13 and the slot 12.

The chamber 17 includes three portions 171, 172 and 173. The portion 171 of the chamber 17 is located at an end of the portion 172 of the chamber 17 while the portion 173 of the chamber 17 is located at another end of the second portion 172 of the chamber 17. The portion 171 of the chamber 17 is in communication with the window 13. The portion 172 of the chamber 17 is in communication with the slot 12 and the screw hole 14. Preferably, the portions 171 and 173 of the chamber 17 are in the form of a circular aperture.

The butt stock butt stock 20 is intended to abut against a user's shoulder. The butt stock 20 is movably connected to the fore-end stock 10. The butt stock 20 includes a contact portion 21, an insert 22, marks 23, a groove 24, and recesses 25.

The shoulder contact portion 21 of the butt stock 20 is intended to abut against a user's shoulder. To this end, the shoulder contact portion 21 of the butt stock 20 includes a rear face in compliance with the user's shoulder.

The insert 22 includes a rear end formed in one piece with the shoulder contact portion 21 of the butt stock 20 and a front end insertable in the chamber 17 of the fore-end stock 10 to movably connect the butt stock 20 to the fore-end stock 10. The insert 22 includes three portions 221, 222 and 223 respectively in compliance with the portions 171, 172 and 173 of the chamber 17. The portion 221 of the insert 22 is insertable in the portion 171 of the chamber 17. The portions 222 of the insert 22 is insertable in the portion 172 of the chamber 17. The portion 223 of the insert 22 is insertable in the portion 173 of the chamber 17.

Preferably, the marks 23 are evenly arranged along a length of the portion 221 of the insert 22. In operation, a selected one of the marks 23 is aligned with the window 13 of the fore-end stock 10.

The groove 24 is made in a lateral face of the portion 222 of the insert 22 in a longitudinal direction of the insert 22. The groove 24 is in communication with the screw hole 14. An axis of the screw hole 14 is pointed at an axis of the groove 24. The groove 24 receives a screw (not shown) extending through the screw hole 14 so that the movement of the insert 22 in chamber 17 is limited.

The recesses 25 are evenly made in the lateral face of the portion 222 of the insert 22. In operation, a selected one of the recesses 25 is aligned to the slot 12 of the fore-end stock 10.

The lock 30 is inserted in the trench 11 and the slot 12 of the fore-end stock 10. The lock 30 includes a lever 31 and at least one spring 32.

The lever 31 includes two pivots (not numbered) inserted in and supported by the lugs 16. The lever 31 is located in the trench 11 of the fore-end stock 10. The lever 31 includes a tongue 311 transversely extending from a first section and a boss 312 transversely extending from a second section. The tongue 311 is shaped in compliance with the slot 12 of the fore-end stock 10. In operation, the tongue 311 is inserted in a selected one of the recesses 25 of the butt stock 20 via the slot 12 of the fore-end stock 10. The boss 312 is aligned to the bore 15 of the fore-end stock 10.

The spring 32 includes an end located in the bore 15 of the fore-end stock 10 and another end receives the boss 312 of the lever 31. Thus, the spring 32 is compressed between the lever 31 and the fore-end stock 10, thereby keeping the tongue 311 of the lever 31 in the selected one of the recesses 25. Accordingly, the butt stock 20 is kept in position relative to the fore-end stock 10.

Figure 6:
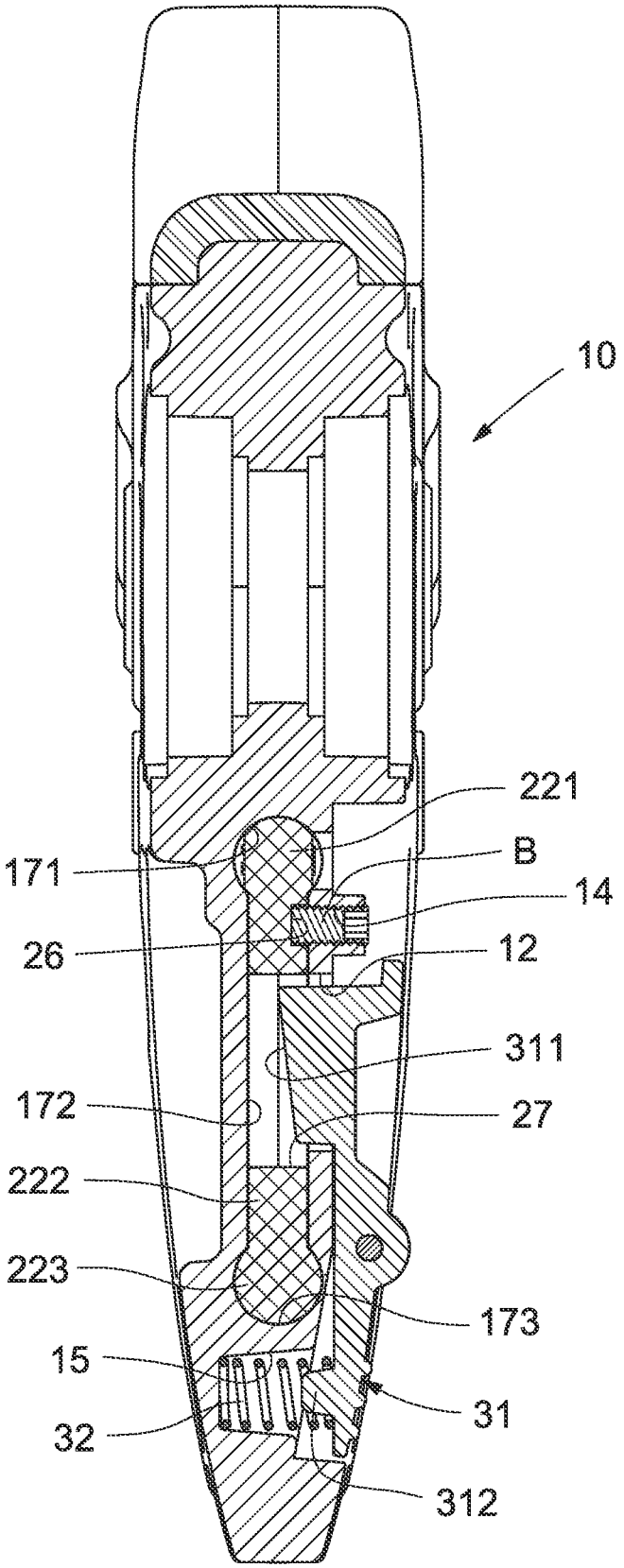
FIG. 6 is a cross-sectional view of the stock assembly taken along a line A-A shown in FIG. 5.
Figure 7:
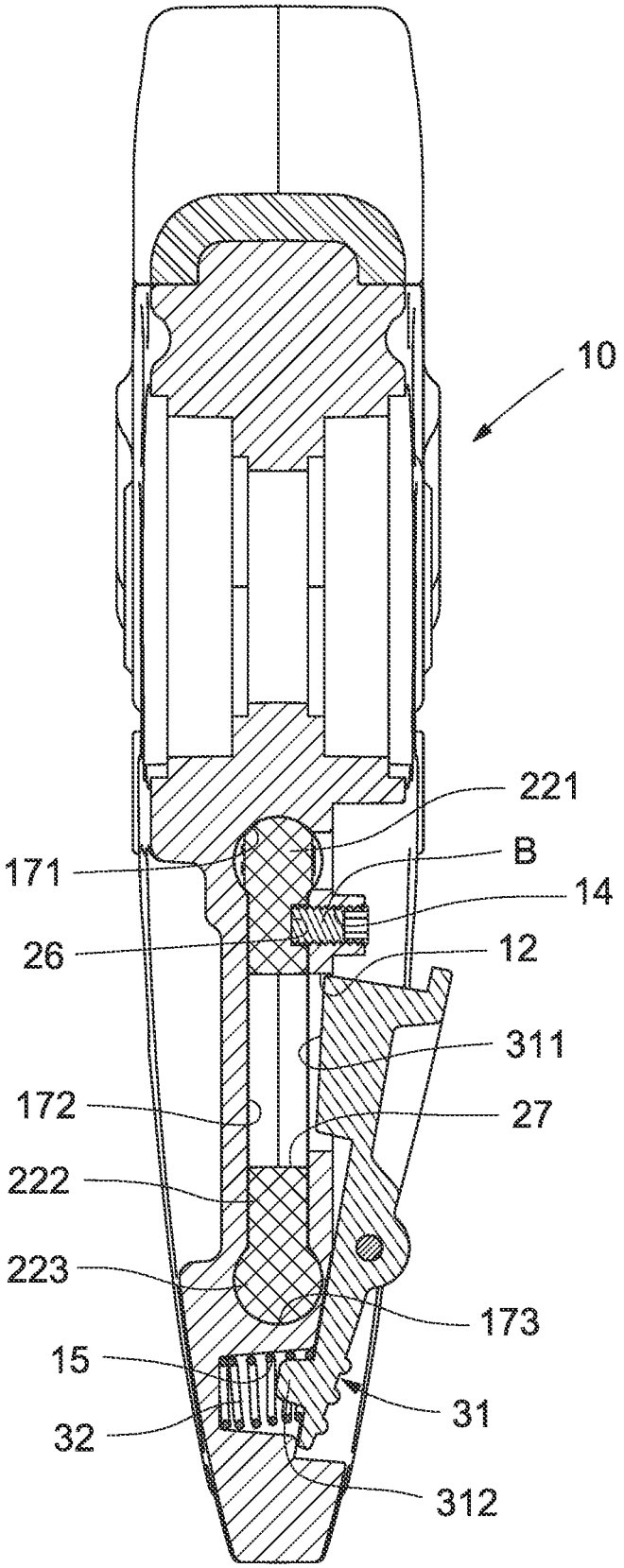
FIG. 7 is a cross-sectional view of the stock assembly in another position than shown in FIG. 1.
Figure 8:
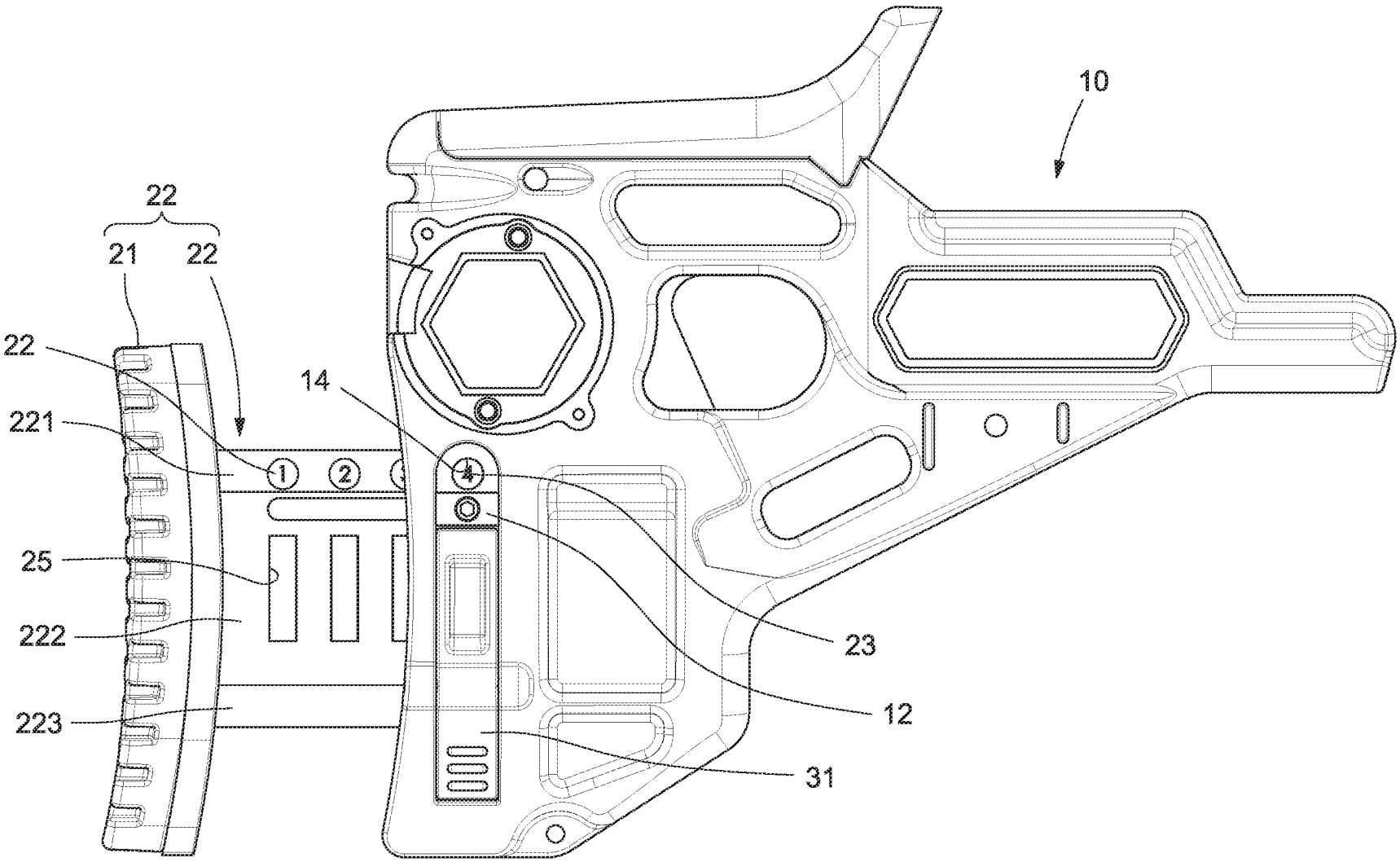
FIG. 8 is a side view of the stock assembly in another position than depicted in FIG. 5.

Referring to FIGS. 6 to 8, and further referring to FIGS. 1 through 5, to adjust the length of the crossbow, i.e., to adjust the length of the stock assembly, the butt stock 20 is moved into or from the fore-end stock 10. To this end, the second section of the lever 31 of the lock 30 is pressed against the spring 32 to move the tongue 311, which extends from the first section of the lever 31, out of the selected one of the recesses 25. Thus, the butt stock 20 is allowed to move relative to the fore-end stock 10.

The marks 23, which are located corresponding to the recesses 25, are observable through the window 13 of the fore-end stock 10. One of the recesses 25 is aligned to the bore 12 and hence ready for receiving the tongue 311 when a corresponding one of the marks 23 is observed through the window 13. Then, the second section of the lever 31 of the lock 30 is released to allow the spring 32 to push the second section of the lever 31. Thus, the lever 31 is pivoted on the lugs 16 of the fore-end stock 10 to insert the tongue 311 of the lever 31 in a newly selected one of the recesses 25 of the butt stock 20. Hence, the butt stock 20 is kept in a newly selected one of the positions relative to the fore-end stock 10.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. An adjustable stock assembly of a crossbow comprising:

a fore-end stock comprising a slot in a lateral face and a chamber in a rear face, wherein the slot is in communication with the chamber;

a butt stock comprising an insert movably inserted in the chamber, a shoulder contact portion formed at an end of the insert out of the chamber, and recesses in a lateral face of the insert; and a lock pivotally connected to the fore-end stock and insertable in a selected one of the recesses through the slot.

2. The adjustable stock assembly according to claim 1, wherein the lock comprises:

a lever pivotally connected to the fore-end stock; and a tongue extensible from a section of the lever into the selected one of the recesses through the slot.

3. The adjustable stock assembly of a crossbow according to claim 2, wherein the lock comprises a spring compressed between the fore-end stock and another section of the lever, thereby keeping the tongue in the selected one of the recesses.

4. The adjustable stock assembly according to claim 2, wherein the fore-end stock comprises a trench for receiving the lever, wherein the slot is located in the trench.

5. The adjustable stock assembly according to claim 2, wherein the lever includes a boss inserted in an end of the spring.

6. The adjustable stock assembly according to claim 5, wherein the fore-end stock comprises a bore for receiving another end of the spring.

7. The adjustable stock assembly according to claim 2, wherein the fore-end stock comprises two lugs for pivotally supporting the lever, wherein the slot is located between the lugs.

8. The adjustable stock assembly according to claim 1, wherein the fore-end stock comprises a screw hole, wherein the insert comprises a groove for movably receiving a screw extending through the screw hole.

9. The adjustable stock assembly according to claim 1, wherein the insert comprises marks located corresponding to the recesses, wherein the fore-end stock comprises a window, wherein a selected one of the recesses is aligned to the slot and ready for receiving the lock when a corresponding one of the marks is observed via the window.

10. The adjustable stock assembly according to claim 1, wherein the chamber comprises portions in various shape, wherein the insert comprises portions respectively inserted in the portions of the chamber.

* * * * *